US005265915A

United States Patent [19]

Seidel et al.

[11] Patent Number: 5,265,915

[45] Date of Patent: Nov. 30, 1993

[54] OPENER FOR FOLDED PRODUCTS

[75] Inventors: Randy R. Seidel, Allentown; Roger Honegger, Andalusia, both of Pa.

[73] Assignee: Graphic Management Associates, Inc., Southborough, Mass.

[21] Appl. No.: 831,695

[22] Filed: Feb. 5, 1992

[51] Int. Cl.[5] ..... B42D 3/00

[52] U.S. Cl. ..... 281/46

[58] Field of Search ..... 281/15.1, 21.1, 28, 281/45, 46; 402/70, 71, 73; 40/904; 248/441.1, 450, 451, 452

[56] References Cited

U.S. PATENT DOCUMENTS

| | | | |
|---|---|---|---|
| 4,486,032 | 12/1984 | Leahy | 281/46 |
| 4,600,329 | 7/1986 | Ferreira-Godinho | 281/46 X |
| 4,743,135 | 5/1988 | Gauntlett | 402/70 |

*Primary Examiner*—Mark Rosenbaum

*Assistant Examiner*—Willmon Fridie, Jr.

*Attorney, Agent, or Firm*—Jordan B. Bierman

[57] ABSTRACT

A device for dividing a product such as a newspaper into two substantially equal portions, the device including a pocket assembly which receives the newspaper (fold down) when open. The pocket then closes and a retainer, at one corner of one pocket wall, prevents the extended portion of the newspaper from curling. A divider splits the newspaper into two portions, and the retainer then moves to a position wherein one of the portions is held between the retainer and the adjacent pocket wall. The pocket assembly is tilted so that the other portion of the newspaper falls away from the first portion as the pocket is opened. At the same time, the divider withdraws and another retainer, at the opposite corner from the first retainer, holds the corresponding corner of the first portion against the pocket wall.

15 Claims, 2 Drawing Sheets

1
1
2
2
3
3
4
5
5
6
6
7
7
8
8
9
9
10
10
13
15
15
16
16

1
2
3
5
6
7
8
10
11
12
13
14

OPENER FOR FOLDED PRODUCTS

The present invention is directed to a device and method for separating a plurality of folded sheets into substantially equal portions; more specifically, it is intended to be used to divide newspaper jackets into such portions so that additional sections may be inserted therein. It is of particular advantage when used to divide tabloids, which are notoriously difficult in this regard. While the present invention is described as being used in connection with newspaper copies, this is for convenience only, as the invention is of substantially broader application.

BACKGROUND OF THE INVENTION

It is well known that newspapers consist of an outer jacket and one or more sections which must be inserted therein. In order to accomplish this, it is necessary to open the jacket so that the additional portions may be readily received. Devices for carrying out this insertion have been known for some time. Basically, they comprise a plurality of pockets which are capable of opening and closing. In their open position, the jacket of the newspaper is inserted, the walls of the pocket are closed, vacuum is applied, and the walls are then opened. The vacuum retains a portion of the paper against each of the two walls. In this position, the additional sections are inserted.

For the most part, devices of this kind are satisfactory for full sized newspapers or broad-sheets. Such papers, when folded in the usual manner, have only two open edges. Both the fold and the spine are closed. Tabloids, on the other hand, have three open edges, as they are folded only at the spine.

Such newspapers present additional and special problems with regard to opening the jackets to permit insertion of additional materials. The vacuum applied to assist opening does not penetrate more than a few pages; thus, there is a substantial tendency for the inner pages in particular to curl downward toward the spine. This interferes with or prevents proper insertion of additional sections.

Even if opening is successfully achieved with a minimum of curled pages, it is common to find that the opening is created at either the first or last two pages of the jacket. As a result, the insertions are likely to tear the pages, rendering the copy unusable.

The problem also exists (although to a lesser degree) in the case of broad-sheets. It is not practical to maintain the spines of such newspapers oriented in the same way in all copies. The spines are somewhat thicker than the open edges and, if no reorientation takes place, stacks of these newspapers will become higher on the spine side than on the open side. Therefore, when they are placed in the pockets for insertion, some have the spine on one side and others have the spine located on the other side. This tends to even the stacks so that they remain horizontal. In some cases, the broad-sheets are alternated, in others a series are inserted in one direction, followed by an equal series oriented in the other direction.

In such cases, similar problems can arise when the division of the newspaper is to be accomplished from the open edges. The problem is, of course, not as serious as it is with tabloids, but it does exist. The present invention is intended to be used with both types of newspapers.

BRIEF DESCRIPTION OF THE INVENTION

It is, therefore, among the objects of the present invention to provide a device and method which will assist in preventing the undesired curling of the newspapers, even in the case of tabloids. It is also among the objects of the invention to provide a device and method for dividing the newspaper substantially at the center thereof so that each divided portion contains approximately the same number of pages.

The present invention comprises a series of moving pockets composed of a first wall and a second wall. The walls are movable toward and away from each other so that the pocket can be opened and closed. Each pocket is also provided with both outer and inner retainers which are located adjacent the upper outer corner and the upper inner corner of the first wall, respectively.

In operation the first and second walls are separated and the jacket is inserted therein. The walls are then moved to a closed position wherein the jacket is held therebetween with the edge remote from the fold extending above the upper edge of the pocket wall. The outer retainer is then moved to a position at which it contacts the surface of the extending portion of the jacket adjacent the wall and thereby prevents the pages from curling. At this point, a divider moves into the outer edge of the jacket, dividing the jacket into two substantially equal portions. The outer retainer then moves into a gripping position holding the upper outer corner of one portion of the jacket against the corresponding corner of the first wall. The opening is extended across the entire width of the jacket and, as this is being accomplished, the inner retainer grips the upper inner corner of the jacket and holds it against the corresponding corner of the first wall. In this way, the jacket is split evenly, the flexible pages are retained in position, and there is no interference with the subsequent insertion of additional sections.

BRIEF DESCRIPTION OF THE DRAWINGS

In the accompanying drawings, constituting a part hereof, in which like reference characters indicate like parts.

DETAILED DESCRIPTION OF THE INVENTION

Figures 1, 2:
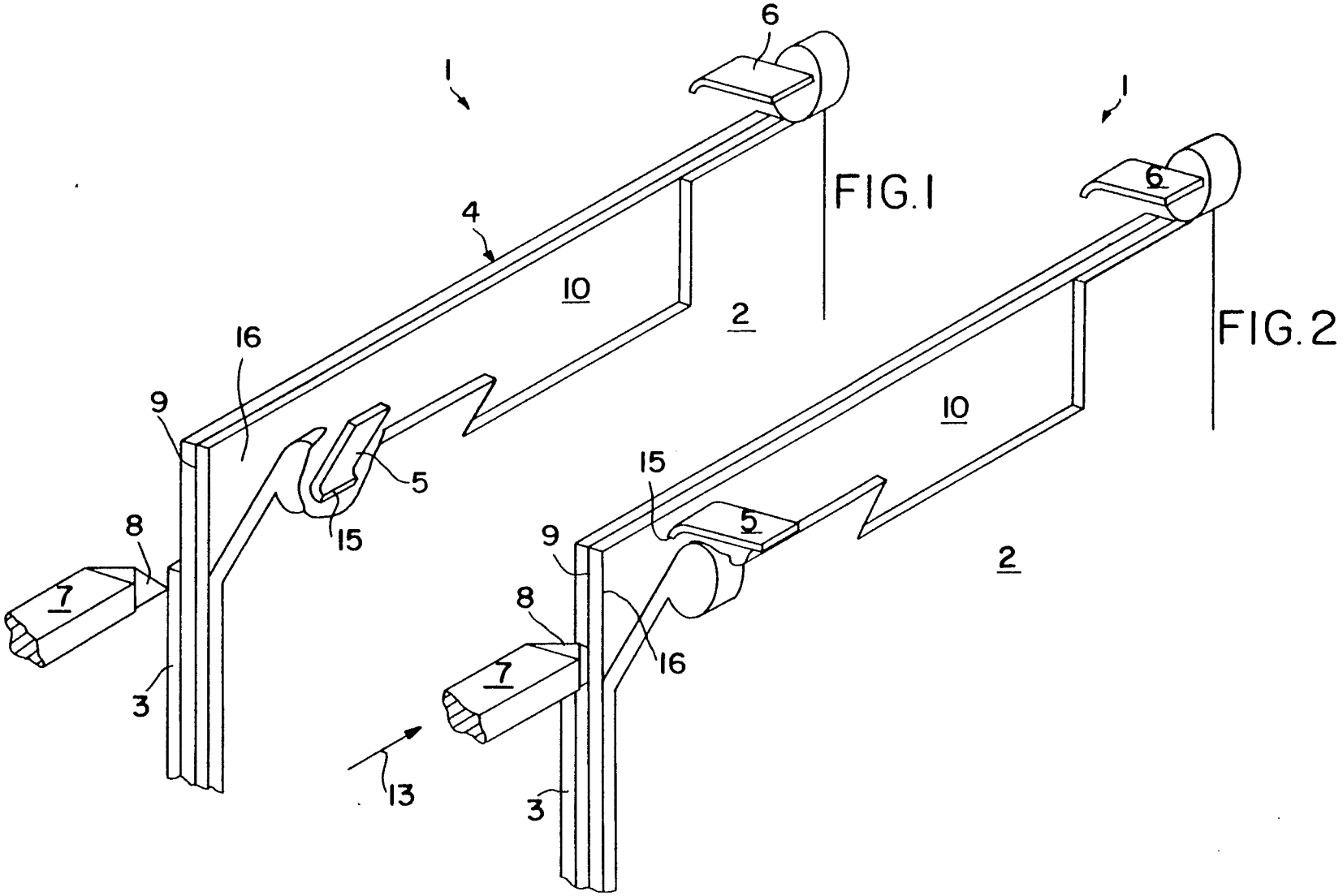
FIG. 1 is a schematic view, with parts omitted for clarity, of the present invention with the jacket in the pocket and the walls in closed position.
FIG. 2 is similar to FIG. 1 and shows the divider beginning to split the jacket.

The present invention comprises pocket assembly 1 (see FIG. 1) which comprises stationary wall 2 and movable wall 3. As can be seen in FIGS. 1 and 2, newspaper jacket 4 is held between movable wall 3 and stationary wall 2. Stationary wall 2 is provided with outer retainer 5 and inner retainer 6. The desired split is at 9.

Jacket 4 is inserted into pocket assembly 1 when movable wall 3 and stationary wall 2 are separated (not shown). Outer retainer 5 is in its closed or gripping position, but, as shown in FIG. 1, no part of jacket 4 is retained thereby.

As divider 7 carrying nose 8 approaches split 9, outer retainer 5 rotates counter clockwise (as seen in FIGS. 1 and 2) and assumes the position shown in FIG. 2. Outer retainer 5 has end 15 which, at this point, bears against outer corner 16 of portion 10 of jacket 4. This prevents the pages of portion 10 closest to stationary wall 2 from curling undesirably.

Figures 3, 4, 5:
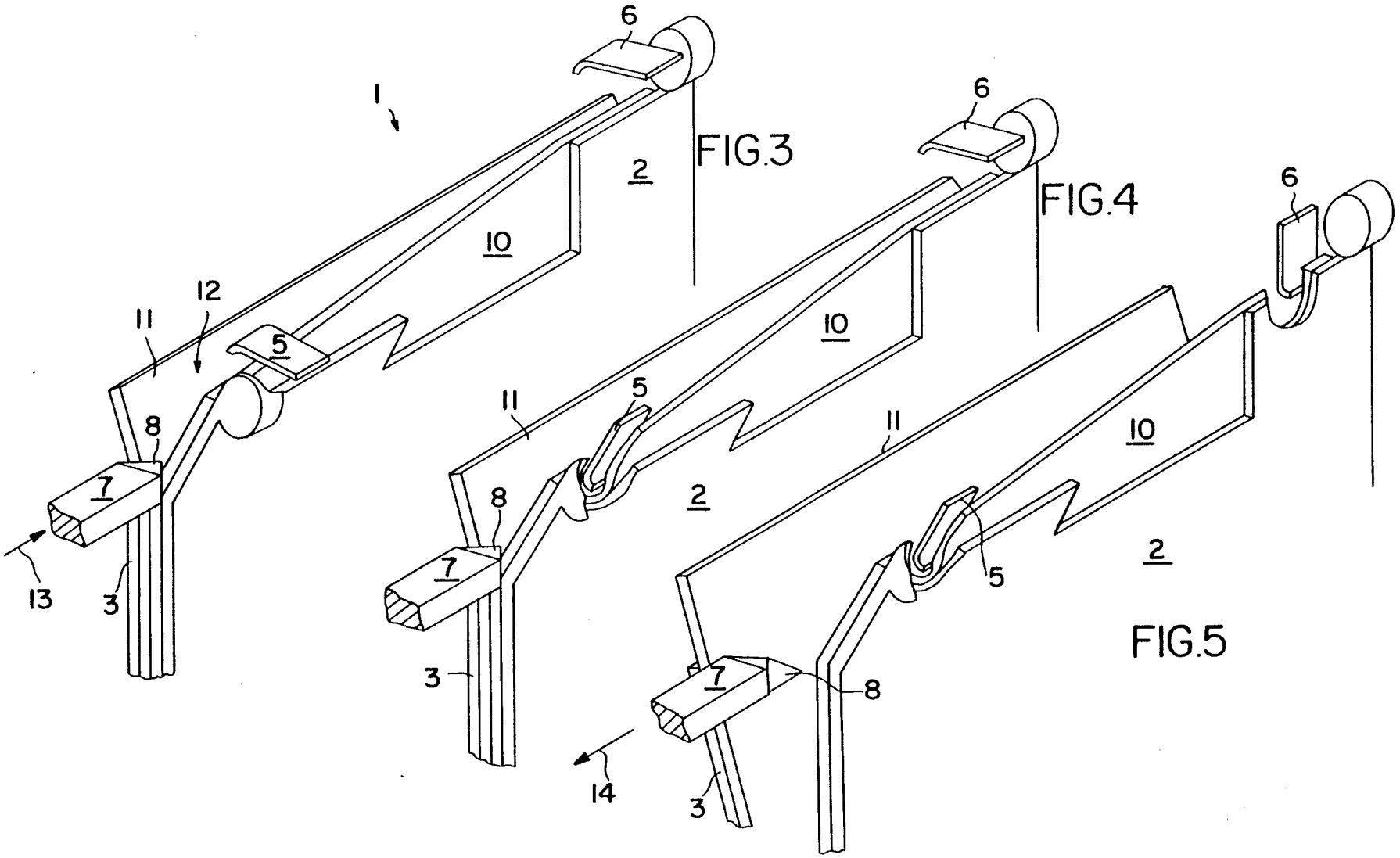
FIG. 3 is a view similar to that of FIG. 2 showing the divider entering the jacket and splitting it into two equal portions.
FIG. 4 is similar to FIG. 3 and shows the outer retainer holding a portion of the jacket against the first wall.
FIG. 5 is similar to FIG. 4 and shows both retainers gripping the jacket and the divider withdrawing.

Divider 7 is moved in the direction of arrow 13 and penetrates jacket 4 at split 9, thereby dividing jacket 4 into equal portions 10 and 11. Most advantageously, divider 7 should enter split 9 very close to, but slightly above, the upper edge of wall 3. This helps to insure that nose 8 enters jacket 4 as close to the middle as possible. Since walls 2 and 3 hold jacket 4 securely, there is little opportunity for the flexible part 16 to bend or droop and thereby be out of alignment with nose 8. As opening 12 is created by divider 7, outer retainer 5 moves to a receiving position wherein it is no longer supporting portion 10 and is out of contact with jacket 4 entirely. This permits portion 10 to move toward wall 2 as shown in FIG. 3. Outer retainer 5 then rotates counter clockwise to its gripping position, holding the corner of portion 10 securely against the corresponding corner of wall 2 (see FIG. 4).

As a result of the tilt of pocket assembly 1, the force of gravity causes opening 12 to extend across the entire width of jacket 4 as portion falls away from portion 10 and wall 3 separates from wall 2. At this point, inner retainer 6 rotates counter clockwise into its gripping position, securing portion 10 against the upper inner corner of wall 2. Divider 7 moves in the direction of arrow 14 to withdraw entirely from jacket 4. In this position, jacket 4 is now ready for the insertion of additional sections.

While only a limited number of specific embodiments of the present invention have been expressly disclosed, it is, nonetheless, to be broadly construed, and not to be limited except by the character of the claims appended hereto.

What we claim is:

1. A device for separating, into two substantially equal portions, a plurality of flexible sheets superposed on each other and folded to form a substantially planar, flexible product, said product having a bottom fold, an inner edge and an outer edge spaced apart from said inner edge, each of said inner edge and said outer edge perpendicular to said fold and an open edge parallel to said fold, and spaced apart therefrom, said device comprising a pocket assembly having a first wall and a second wall forming a closable pocket, said first wall and said second wall adapted for movement between an open position, wherein said first wall is spaced apart from said second wall, and a closed position, wherein said first wall is adjacent said second wall and said product is secured therebetween, said pocket having a lower edge, an inner side and an outer side, both perpendicular to said lower edge, and spaced apart from each other, and upper edges parallel to said lower edge and spaced apart therefrom, said pocket, when in said open position, adapted to receive said product with said fold adjacent said lower edge, an outer retainer on said first wall and adjacent said outer side and one of said upper edges, an inner retainer on said first wall and adjacent said inner side and one of said upper edges, said outer retainer having a gripping position, wherein said outer retainer holds one portion against said first wall; a clear position, wherein said outer retainer is out of contact with said product; and a supporting position, wherein said one portion rests against said outer retainer; said inner retainer having a gripping position, wherein said inner retainer holds another said portion against said first wall, and a release position, wherein said inner retainer is out of contact with said product, a divider adapted for movement parallel to said fold at an outer point spaced therefrom, between an entry position, wherein said divider has entered said product adjacent said outer edge and divided said product into two said portions adjacent said outer edge to form an opening therebetween, and a withdrawn position, wherein said divider is out of contact with said product, said outer retainer being in said supporting position, said inner retainer being in said release position, and said first wall and said second wall being in said closed position when said device enters said product.

2. The device of claim 1 wherein, after formation of said opening, said outer retainer is in said gripping position to permit extension of said opening toward said inner retainer.

3. The device of claim 2 wherein said inner retainer is in said gripping position when said opening reaches said inner retainer.

4. The device of claim 1 wherein said divider is provided with a nose having a point tapering toward said outer edge.

5. The device of claim 1 wherein said divider is adjacent one of said upper edges.

6. The device of claim 1 wherein said first wall is fixed and said second wall is movable toward and away from said first wall.

7. The device of claim 1 wherein said product is a newspaper.

8. The product of claim 7 wherein said inner side and said outer side are open.

9. The device of claim 1 wherein said outer retainer has a release position, wherein said outer retainer is out of contact with said product.

10. A method of separation, into two substantially equal portions, of a plurality of flexible sheet superposed on each other and folded to form a substantially planar, flexible product with a bottom fold, an inner edge and, spaced apart therefrom, an outer edge, said inner edge and said outer edge being perpendicular to said fold, and an upper edge parallel to said fold and spaced apart therefrom, said method comprising retaining said product between a first wall and a second wall of a pocket with a part of said product extending above said walls, moving a divider parallel to said fold into said product at said outer edge at a point vertically spaced from said fold to form an opening adjacent said outer edge, thereby dividing said product into said portions, supporting said part to restrain said sheets in said part from curling towards said first wall at a point adjacent said outer edges during said moving.

11. The method of claim 10 comprising retaining said part against said first wall at said outer point adjacent said outer edge and said upper edge after formation of said opening.

12. The method of claim 10 comprising extending said opening to an inner point adjacent said inner edge and said upper edge.

13. The method of claim 12 comprising retaining said part against said first wall and said inner point.

14. The method of claim 10 wherein said divider is withdrawn from said product after said opening is formed.

15. The method of claim 10 wherein said outer point is adjacent an upper edge of said first wall and/or said second wall.

* * * * *